US008636063B2

(12) United States Patent
Ravi et al.

(10) Patent No.: US 8,636,063 B2
(45) Date of Patent: Jan. 28, 2014

(54) CEMENT SLURRY MONITORING

(75) Inventors: Kris Ravi, Kingwood, TX (US); Etienne Samson, Houston, TX (US); John L. Maida, Houston, TX (US); William John Hunter, Northampton (GB)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 13/028,542

(22) Filed: Feb. 16, 2011

(65) Prior Publication Data

US 2012/0205103 A1 Aug. 16, 2012

(51) Int. Cl.
*E21B 33/13* (2006.01)

(52) U.S. Cl.
USPC ..... 166/253.1; 166/286

(58) Field of Classification Search
USPC ..... 166/253.1, 286
See application file for complete search history.

(56) References Cited

U.S. PATENT DOCUMENTS

| | | | | |
|---|---|---|---|---|
| 3,019,841 | A | 2/1962 | Ternow et al. | |
| 4,120,166 | A * | 10/1978 | Brooks, Jr. | 405/225 |
| 4,407,365 | A | 10/1983 | Cooke, Jr. | |
| 4,760,563 | A | 7/1988 | Beylkin | |
| 4,785,247 | A | 11/1988 | Meador et al. | |
| 4,896,303 | A | 1/1990 | Leslie et al. | |
| 5,037,172 | A | 8/1991 | Hekman et al. | |
| 5,214,614 | A | 5/1993 | Baule | |
| 5,429,190 | A | 7/1995 | Kilgore et al. | |
| 5,626,192 | A | 5/1997 | Connell et al. | |
| 5,892,860 | A | 4/1999 | Maron et al. | |
| 6,053,245 | A | 4/2000 | Haberman | |
| 6,160,762 | A | 12/2000 | Luscombe et al. | |
| 6,188,645 | B1 | 2/2001 | Maida, Jr. et al. | |
| 6,195,162 | B1 | 2/2001 | Varnham et al. | |
| 6,211,964 | B1 | 4/2001 | Luscombe et al. | |
| 6,233,746 | B1 | 5/2001 | Skinner | |

(Continued)

FOREIGN PATENT DOCUMENTS

| | | | |
|---|---|---|---|
| GB | 2401178 | A | 3/2004 |
| WO | WO2010/090660 | A1 | 8/2010 |
| WO | WO-2012/136951 | A3 | 10/2012 |

OTHER PUBLICATIONS

Angelidis, Diogenes et al., "Optical Micromachined Pressure Sensor for Aerospace Applications", Optical Engineering, vol. 31, No. 8, (Aug. 1992), 1636-1642.

(Continued)

*Primary Examiner* — William P Neuder
(74) *Attorney, Agent, or Firm* — Krueger Iselin LLP

(57) ABSTRACT

Various disclosed cement slurry monitoring methods include monitoring one or more parameter of the cement slurry at various positions along the borehole during the curing process and responsively identifying a span over which the slurry extends and whether there are any gaps or voids in that span. At least some system embodiments include a distributed sensing arrangement to provide parameter measurements as a function of position and time during the curing process. A computer analyzes the measurements to determine the span of the cement slurry and whether any gaps exist. Contemplated measurement parameters include temperature, pressure, strain, acoustic spectrum, acoustic coupling, and chemical concentration. Individually or in combination, these measurements can reveal in real time the state of the cement slurry and can enable remedial actions to be taken during or after the curing process if needed to address deficiencies in the annular seal being provided by the cement.

21 Claims, 5 Drawing Sheets

(56) References Cited

U.S. PATENT DOCUMENTS

| | | | | |
|---|---|---|---|---|
| 6,256,588 | B1 | 7/2001 | Maida et al. | |
| 6,268,911 | B1 | 7/2001 | Tubel et al. | |
| 6,307,809 | B1 | 10/2001 | Luscombe et al. | |
| 6,408,943 | B1 | 6/2002 | Schultz et al. | |
| 6,422,084 | B1 | 7/2002 | Fernald et al. | |
| 6,522,797 | B1 | 2/2003 | Siems et al. | |
| 6,591,025 | B1 | 7/2003 | Siems et al. | |
| 6,731,389 | B2 | 5/2004 | Luscombe et al. | |
| 6,789,621 | B2 | 9/2004 | Wetzel et al. | |
| 6,834,233 | B2 | 12/2004 | Economides et al. | |
| 6,847,034 | B2 | 1/2005 | Shah et al. | |
| 6,907,170 | B1 | 6/2005 | Maida | |
| 6,913,083 | B2 | 7/2005 | Smith | |
| 6,931,188 | B2 | 8/2005 | Kersey et al. | |
| 6,957,574 | B2 | 10/2005 | Ogle | |
| 7,006,918 | B2 | 2/2006 | Economides et al. | |
| 7,095,012 | B2 | 8/2006 | Fujisawa et al. | |
| 7,104,324 | B2 | 9/2006 | Wetzel et al. | |
| 7,159,468 | B2 | 1/2007 | Skinner et al. | |
| 7,163,055 | B2 | 1/2007 | Coon et al. | |
| 7,182,134 | B2 | 2/2007 | Wetzel et al. | |
| 7,219,729 | B2 | 5/2007 | Bostick, III et al. | |
| 7,219,730 | B2 | 5/2007 | Tilton et al. | |
| 7,245,791 | B2 | 7/2007 | Rambow et al. | |
| 7,408,645 | B2 | 8/2008 | DiFoggio | |
| 7,409,858 | B2 | 8/2008 | Dria et al. | |
| 7,458,273 | B2 | 12/2008 | Skinner et al. | |
| 7,461,547 | B2 | 12/2008 | Terabayashi et al. | |
| 7,511,823 | B2 | 3/2009 | Schultz et al. | |
| 7,529,434 | B2 | 5/2009 | Taverner et al. | |
| 7,641,395 | B2 | 1/2010 | Ringgenberg et al. | |
| 7,665,543 | B2 | 2/2010 | Bostick, III et al. | |
| 7,864,321 | B2 | 1/2011 | Caron et al. | |
| 7,938,178 | B2 | 5/2011 | Ringgenberg et al. | |
| 2002/0104656 | A1* | 8/2002 | Murley et al. | 166/291 |
| 2003/0205375 | A1 | 11/2003 | Wright et al. | |
| 2003/0210403 | A1 | 11/2003 | Luscombe et al. | |
| 2005/0072678 | A1 | 4/2005 | Hunter et al. | |
| 2005/0207279 | A1 | 9/2005 | Chemali et al. | |
| 2006/0081412 | A1 | 4/2006 | Wright et al. | |
| 2008/0185138 | A1* | 8/2008 | Hernandez-Solis et al. | 166/60 |
| 2008/0227669 | A1 | 9/2008 | Welton | |
| 2009/0120640 | A1 | 5/2009 | Kulakofsky et al. | |
| 2009/0271115 | A1 | 10/2009 | Davis et al. | |
| 2010/0200743 | A1 | 8/2010 | Forster et al. | |
| 2010/0200744 | A1 | 8/2010 | Pearce et al. | |
| 2011/0090496 | A1 | 4/2011 | Samson et al. | |
| 2011/0109912 | A1 | 5/2011 | Spross et al. | |
| 2012/0063267 | A1* | 3/2012 | Hill et al. | 367/82 |
| 2012/0118567 | A1* | 5/2012 | Cooke, Jr. | 166/286 |
| 2012/0132417 | A1* | 5/2012 | Dria et al. | 166/250.01 |

OTHER PUBLICATIONS

Aratani, K. "Process and Design Considerations for Surface Micromachined Beams for a Tuneable Interferometer Array in Silicon", IEEE Xplore, IEEE, 1993, pp. 230-235.

Burns, D. W., et al., "Thin Films for Micromechanical Sensors", J. Vac. Sci. Technol. A 8(4), American Vacuum Society, (Jul. 1990), pp. 3606-3613.

Graber, Karen K., et al., "Drill String Tool Sheet", Overview of Ocean Drilling Program, http://www.odp.tamu.edu/publications/tnotes/tn31/drill_s/drill_s.htm> (retrieved Sep. 21, 2009), (Jul. 2004), pp. 1-3.

Halliburton Energy Services, Inc, "StimWatch Stimulation Monitoring Service—FiberWatch Fiber Optic Distributed Temperature Sensing Technology", Pinnacle, a Halliburton Services, http://www.halliburton.com/public/pe/contents/Data_Sheets/web/H/H04481.pdf, 2010, 4 pages.

IEEE, "IEEE Standard for Long Wavelength Wireless Network Protocol", IEEE Std 1902.1, New York, NY, (Mar. 31, 2009), 35 pgs.

Johnson, R. L., et al., "Miniature Instrument for the Measurement of Gap Thickness Using Poly-Chromatic Interferometry", *Center for Astronomical Adaptive Optics, Steward Observatory*, The University of Arizona, Tucson, AZ, (Unkn), 9 pgs.

Li, Weizhuo et al., "Wavelength Multiplexing of Microelectromechanical System Pressure and Temperature Sensors Using Fiber Bragg Gratings and Arrayed Waveguide Gratings", Opt. Eng. Society of Photo-Optical Instrumentation Engineers, 0091-3286/2003, (Feb. 2003), pp. 431-438.

MacDougall, Trevor W., et al., "Large Diameter Waveguide Bragg Grating Components and Their Application in Downhole Oil & Gas Sensing", Weatherford International, Wallingford, CT, (Unkn),12 pgs.

PCT Internat'l Search Report and Written Opinion, dated Sep. 29, 2009, Appl No. PCT/US2009/053492, A Near-Field Electromagnetic Communications Network for Downhole Telemetry, filed Aug. 11, 2009 7 pgs.

Pitcher, R. J., et al., "Optothermal Drive of Silicon Resonators: The Influence of Surface Coatings", *Sensors and Actuators*, A21-23, (1990), pgs. 387-390.

Putty, Michael W., et al., "Process Integration for Active Polysilicon Resonant Microstructures", Sensors and Actuators, 20, (1989), pp. 143-151.

Samson, Etienne et al., "A Near-Field Electromagnetic Communications Network for Downhole Telemetry", PCT Appl No. US09/53492, filed Aug. 11, 2009, 15 pgs.

Oil and Gas Eseurasia, "Pioneer Real-time Compaction Imaging System", Oil&Gas Eurasia, http://www.oilandgaseurasia.com/news/p/2/news/5146, Jun. 29, 2009, 2 pgs.

Thompson Reuters, "RuBee, High-Security, Harsh-Environment RFID Alternative", http:/'/www.reuters.com/article/pressRelease/idUS260082+11-Feb-2009+BW20090211>; (retrieved Sep. 21, 2009), (Feb. 11, 2009), pp. 1-2.

Tseng, Fan-Gang et al., "Polymer MEMS-Based Fabry-Perot Shear Stress Sensor", *IEEE Sensors Journal*, vol. 3, No. 6, (Dec. 2003), pp. 812-817.

Tudor, M.J. et al., "Silicon Resonator Sensors: Interrogation Techniques and Characteristics", IEE Proceedings, vol. 135, Pt. D, No. 5, (Sep. 1988),pp. 364-368.

Unknown, "Optical Activation of a Silicon Vibrating Sensor", Electronic Letters, vol. 22, No. 21, (Oct. 9, 1986), pp. 1097-1099.

"PCT International Search Report and Written Opinion", dated Jun. 20, 2012, Appl No. PCT/GB2012/000154, "Cement Slurry Monitoring", filed Feb. 15, 2012, 13 pgs.

Levine, Dennis C. et al., "Annular Gas Flow After Cementing: A Look at Practical Solutions", 54th Ann. Fall Tech. Conf. And Exhib. of the SPE, Paper No. 8255, (Sep. 23, 1979), 11 pgs.

Ravi, Kris et al., "Cement Slurry Monitoring", U.S. Appl. No. 13/028,542, filed Feb. 16, 2011, (Aug. 16, 2012), 19 pgs.

"PCT Written Opinion of the International Preliminary Examining Authority", dated Jul. 15, 2013, Appl No. PCT/GB2012/000298, "Optical Fiber Based Downhole Seismic Sensor Systems and Methods", filed May 30, 2012, 5 pgs.

"Non-Final Office Action", dated Jun. 27, 2013, U.S. Appl. No. 13/082,522, "Optical Fiber Based Downhole Seismic Sensor Systems and Methods", filed Apr. 8, 2011, 35 pgs.

* cited by examiner

FIG. 3A
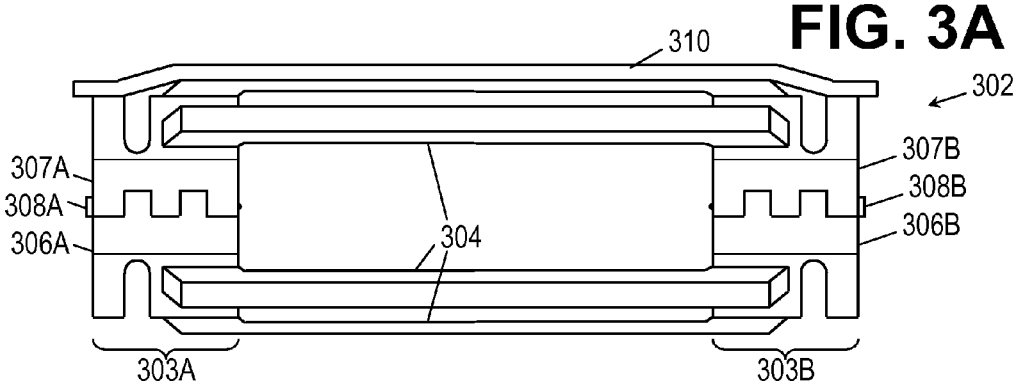
FIG. 3B
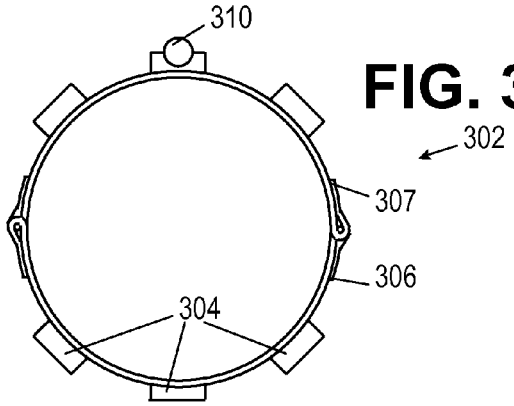
FIG. 4
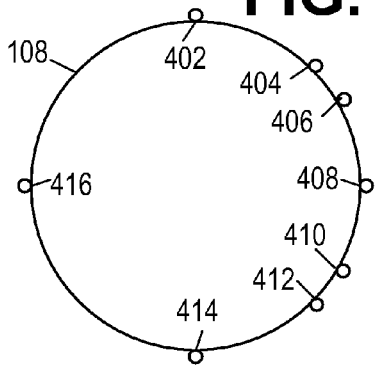
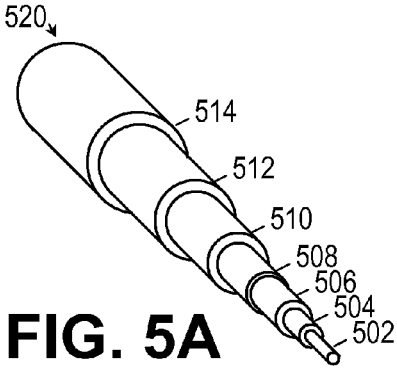
FIG. 5A
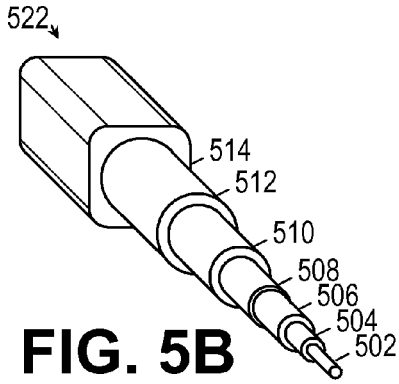
FIG. 5B

CEMENT SLURRY MONITORING

BACKGROUND

As wells are drilled to greater lengths and depths, it becomes necessary to provide a liner ("casing") to avoid undesirable fluid inflows or outflows and to prevent borehole collapse. The annular space between the borehole wall and the liner is usually filled with cement to reinforce structural integrity and to prevent fluid flows along the outside of the liner. If such fluid flows are not prevented, there is a loss of zonal isolation. Fluids from high-pressured formations can enter the borehole and travel along the outside of the casing to invade lower-pressured formations, or possibly to exit the borehole in a mixture that dilutes the desired production fluid. Results may include contamination of aquifers, damage to the hydrocarbon reservoir, and loss of well profitability.

The job of cementing the casing in place has several potential pitfalls. For example, as the borehole wall can be quite irregular, the volume of the annular space between the casing and the borehole wall is somewhat unpredictable. Moreover, there may be voids, fractures, and/or porous formations that allow cement slurry to escape from the borehole. Conversely, fluids (including gasses) can become trapped and unable to quickly escape from the annular space, thereby preventing the cement slurry from fully displacing such materials from the annular space. (Any such undisplaced fluids provide potential fluid flow paths that can lead to a loss of zonal isolation). Accordingly, the cementing crew may have difficulty predicting how much of the well will be successfully cemented by a given volume of cement slurry.

Further, the chemical composition of the cement slurry may be altered for various reasons including slowing the setting time (i.e., the slurry's transition time from liquid to solid state). Depending on the downhole conditions, the expected setting time can be very different from the actual setting time. For example, temperature is a key factor for the setting time. Although temperature modeling software is available, there are many drivers that affect the downhole temperature during the cement curing process including: temperature of the injected cement slurry; temperature profile and heat conductivity of the formation; and heat of hydration. Consequently the actual temperature regime in the borehole may be different from the estimated profile and therefore the setting time may be different. Currently well operators and regulatory authorities rely upon "rules of thumb" and cement slurry tests undertaken with estimated parameters to govern how and when well operations may commence after cement placement. As incompletely set cement is more susceptible to damage, the uncertainty regarding setting time often requires a balancing of risks, e.g., balancing the risk of fractured cement with undesirable delays in completing the well. Moreover, unexpectedly lengthened setting times increase the risks of fluid influx from the formation, which can create undesired fluid flow paths.

BRIEF DESCRIPTION OF THE DRAWINGS

FIGS. 3A-3B show an illustrative mounting assembly.

FIG. 4 shows an illustrative angular distribution of sensing fibers.

FIGS. 5A-5D show illustrative sensing fiber constructions.

NOMENCLATURE

The terms "including" and "comprising" are used in an open-ended fashion, and thus should be interpreted to mean "including, but not limited to . . . ". The term "couple" or "couples" is intended to mean either an indirect or direct electrical, mechanical, or thermal connection. Thus, if a first device couples to a second device, that connection may be through a direct connection, or through an indirect connection via other devices and connections. Conversely, the term "connected" when unqualified should be interpreted to mean a direct connection. The term "fluid" as used herein includes materials having a liquid or gaseous state.

DETAILED DESCRIPTION

The issues identified in the background are at least partly addressed by the various cement slurry monitoring systems and methods disclosed herein. At least some method embodiments include monitoring one or more parameter of the cement slurry at various positions along the borehole during the curing process and responsively identifying a span over which the slurry extends and whether there are any gaps or voids in that span. At least some system embodiments include a distributed sensing arrangement to provide parameter measurements as a function of position and time during the curing process. A data processing system analyzes the measurements to determine the span of the cement slurry and whether any gaps exist.

Contemplated measurement parameters include temperature, pressure, strain, acoustic spectrum, acoustic coupling, and chemical concentration. Individually or in combination, these measurements can reveal in real time the state of the cement slurry and can enable remedial actions to be taken during or after the curing process if needed to address deficiencies in the annular seal being provided by the cement. Distributed sensing of these contemplated parameters is available via optical fiber systems or spaced arrays of sensors mounted to the exterior of the well casing.

Figure 1:
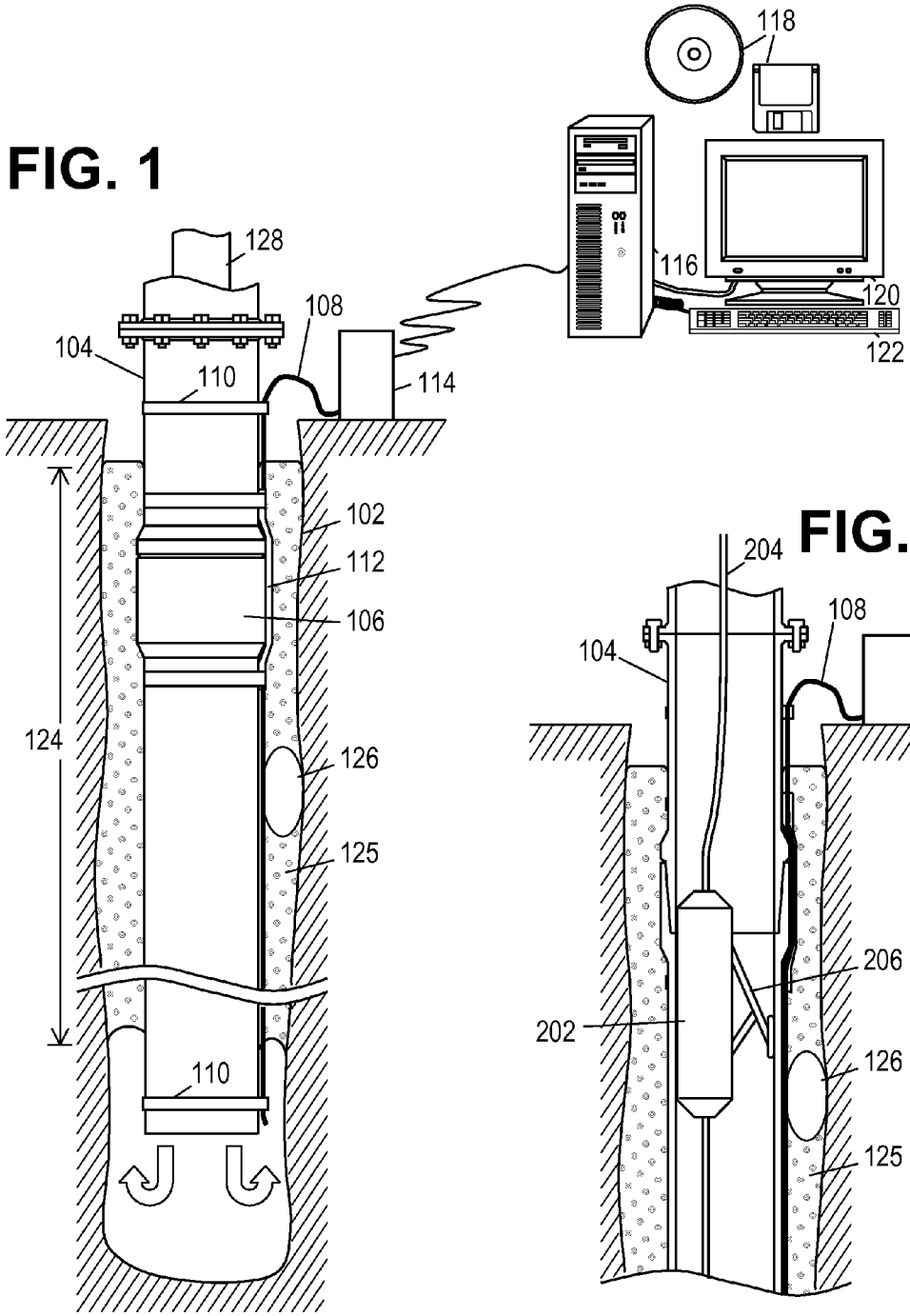
FIG. 1 shows an illustrative well with a cement slurry monitoring system.

The disclosed systems and methods are best understood in terms of the context in which they are employed. Accordingly, FIG. 1 shows an illustrative borehole 102 that has been drilled into the earth. Such boreholes are routinely drilled to ten thousand feet or more in depth and can be steered horizontally for perhaps twice that distance. During the drilling process, the driller circulates a drilling fluid to clean cuttings from the bit and carry them out of the borehole. In addition, the drilling fluid is normally formulated to have a desired density and weight to approximately balance the pressure of native fluids in the formation. Thus the drilling fluid itself can at least temporarily stabilize the borehole and prevent blowouts.

To provide a more permanent solution, the driller inserts a casing string 104 into the borehole. The casing string 104 is normally formed from lengths of tubing joined by threaded tubing joints 106. The driller connects the tubing lengths together as the casing string is lowered into the borehole. During this process, the drilling crew can also attach a fiber optic cable 108 and/or an array of sensors to the exterior of the casing with straps 110 or other mounting mechanisms such as those discussed further below. Because the tubing joints 106 have raised profiles, cable protectors 112 may be employed to guide the cable over the joints and protect the cable from getting pinched between the joint and the borehole wall. The drillers can pause the lowering of the casing at intervals to unreel more cable and attach it to the casing with straps and protectors. In many cases it may be desirable to provide small diameter tubing to encase and protect the optical fiber cable. The cable can be provided on the reel with flexible (but crush-resistant) small diameter tubing as armor, or can be seated within inflexible support tubing (e.g., via a slot) before being attached to the casing. Multiple fiber optic cables can be deployed within the small diameter tubing for sensing different parameters and/or redundancy.

Once the casing has been placed in the desired position the cable(s) can be trimmed and attached to a measurement unit 114. The measurement unit 114 supplies laser light pulses to the cable(s) and analyzes the returned signal(s) to perform distributed sensing of one or more parameters along the length of the casing. Contemplated measurement parameters include temperature, pressure, strain, acoustic (noise) spectra, acoustic coupling, and chemical (e.g., hydrogen or hydroxyl) concentration. Fiber optic cables that are specially configured to sense these parameters and which are suitable for use in harsh environments are commercially available. The light pulses from the measurement unit pass through the fiber and encounter one or more parameter-dependent phenomena. Such phenomena may include spontaneous and/or stimulated Brillouin (gain/loss) backscatter. Typical silica-based optical fibers are sensitive to density changes which, for appropriately configured fibers, are indicative of strain or temperature. Parameter variations modulate inelastic optical collisions within the fiber, giving a detectable Brillouin sub-carrier optical frequency shift in the 9-11 GHz range. Typical strain and temperature coefficients are 50 kHz/microstrain and about 1 MHz/° C., respectively.

Other phenomena useful for parameter measurement include incoherent and coherent Raleigh backscatter. Physical microbending/macrobending of the fiber and infrared atomic and molecular specie absorption in the optical fiber produce optical intensity loss. In the case of coherent (optical laser source having a spectrum less than a few kHz wide) reflected signals via "virtual mirrors" cause detectable interferometric optical carrier phase change as a function of dynamic strain (acoustic pressure and shear vibration) via elastic optical collisions with glass fiber media.

Still other phenomena useful for parameter measurement include spontaneous and/or stimulated Raman backscatter (temperature variations produce inelastic Stokes and Anti-Stokes wavelength bands above and below the laser probe wavelength. Inelastically-generated Anti-Stokes light intensity level is a function of absolute temperature while inelastically generated Stokes light intensity is not as sensitive to temperature. The intensity ratio of Anti-Stokes to Stokes optical power/intensity is directly proportional to absolute temperature.

To collect such measurements the measurement unit 114 may feed tens of thousands of laser pulses each second into the optical fiber and apply time gating to the reflected signals to collect measurements at different points along the length of the cable. The measurement unit can process each measurement and combine it with other measurements for that point to obtain a high-resolution measurement of that parameter. Though FIG. 1 shows a continuous cable as the sensing element, alternative embodiments of the system may employ an array of spaced-apart sensors that communicate measurement data via wired or wireless channels to the measurement unit 114. A general purpose data processing system 116 can periodically retrieve the measurements as a function of position and establish a time record of those measurements. Software (represented by information storage media 118) runs on the general purpose data processing system to collect the measurement data and organize it in a file or database.

The software further responds to user input via a keyboard or other input mechanism 122 to display the measurement data as an image or movie on a monitor or other output mechanism 120. As explained further below, certain patterns in the measurement data are indicative of certain material properties in the environment around the cable or measurement array. The user may visually identify these patterns and determine the span 124 over which injected cement slurry 125 extends. Alternatively, or in addition, the software can process the data to identify these patterns and responsively determine the span 124. Any gaps 126 that exist or form in the cement slurry 125 can be similarly determined. (Such gaps 126 can, for example, be the result of trapped fluids or be the result of fluid inflow from the formation). Some software embodiments may provide an audible and/or visual alert to the user if patterns indicate the presence or formation of gaps in the cement slurry.

To cement the casing 104, the drilling crew injects a cement slurry 125 into the annular space (typically by pumping the slurry through the casing 104 to the bottom of the borehole, which then forces the slurry to flow back up through the annular space around the casing 104). It is expected that the software and/or the crew will be able to monitor the measurement data in real time or near real time to observe the profile of the selected parameter (i.e., the value of the parameter as a function of depth) and to observe the evolution of the profile (i.e., the manner in which the profile changes as a function of time). From the evolution of the profile, it is expected that the software and/or the user will be able to verify whether the desired span has been achieved without gaps quickly enough to take corrective action if necessary.

There are several corrective actions that the crew might choose to take. If the crew determines that the span 124 is inadequate (e.g., due to an unexpectedly large annular volume), they can arrange to have more cement slurry injected into the annular space. Alternatively, if the span 124 determined to have been achieved more quickly than anticipated, the crew can stop injecting cement slurry into the annulus and employ an inner tubing string 128 to circulate the unneeded slurry out of the casing string. If the crew detects gaps 126 attributable to a bubble of trapped fluid, vibratory energy can be supplied to the casing to decrease the viscosity of the slurry and enable the bubble to escape. One mechanism for supplying vibratory energy is to rotate or swing an inner tubing string 128. Motion imparted to the inner tubing string causes the inner tubing string to "bang around" inside the casing string 104, thereby supplying acoustic energy to the cement slurry.

Figure 2:
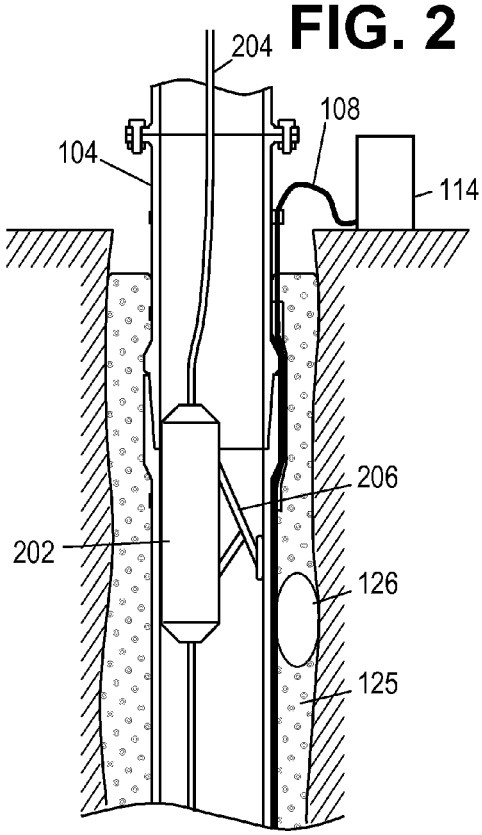
FIG. 2 shows an illustrative cement slurry monitoring system with an agitation system.

FIG. 2 shows an alternative mechanism for providing vibratory energy. One or more tools 202 are lowered into the casing 104 on a wireline cable 204. Legs 206 may optionally be extended from the tools 202 to firmly seat the tools 202 against the inner wall of the casing string. The tools 202 each include a motor that drives an axle having eccentric weights. As the motor spins the axle, the eccentric weights cause a severe vibration of the tool body. If the tool body is kept in contact with the casing wall, the vibration is mechanically transmitted through the wall to the cement slurry. Otherwise the vibration causes the tool body to swing and "bang around" inside the casing, thereby imparting vibratory energy to the slurry.

Separately, or in conjunction with supplying vibratory energy, the crew may increase the pressure in the annulus. (This corrective action may be particularly suitable if gaps 126 are attributable to fluid inflows from the formation). One way to increase the annular pressure is to provide a mechanical seal between the rim of the borehole 102 and the casing string 104, and then force more fluid into the annulus via the casing string or via a port in the seal.

In some cases, the corrective action may be delayed until after the cement slurry has set into a solid cement sheath. With the knowledge of gap locations provided by the sensing fiber(s), the operators can cut or penetrate through the casing at strategic points and inject fluids as needed to clean and prime the voids and fill them with cement slurry, thereby producing an integral cement sheath.

Note that other vibratory energy or sound sources can be employed. In some embodiments, vibrators can be mounted at various points to the exterior of the casing. In other embodiments, fluid sirens or seismic energy sources are deployed inside the casing. Particularly where an extended pumping period is expected, the vibrators or sound sources can be operated throughout the pump-in to maintain the non-gel flow properties of the cement slurry. Such ongoing operation of these noise sources can be used to measure acoustic coupling between the sensing fiber and the casing, as well as other ringing or attenuation properties of the annular fluid that would reveal the type of fluid and the presence or absence of bubbles.

Fiber sensor cable 108 may be attached to the casing string 104 via straight linear, helical, or zig-zag strapping mechanisms. FIGS. 3A and 3B show an illustrative straight strapping mechanism 302 having an upper collar 303A and a lower collar 303B joined by six ribs 304. The collars each have two halves 306, 307 joined by a hinge and a pin 308. A guide tube 310 runs along one of the ribs to hold and protect the cable 108. To attach the strapping mechanism 302 to the casing string 104, the drilling crew opens the collars 303, closes them around the casing, and hammers the pins 308 into place. The cable 108 can then be threaded or slotted into the guide tube 310. The casing string 104 is then lowered a suitable distance and the process repeated.

Some embodiments of the straight strapping mechanism can contain multiple cables within the guide tube 310, and some embodiments include additional guide tubes along other ribs 304. FIG. 4 shows an illustrative arrangement of multiple cables 402-416 on the circumference of a casing string 108. Taking cable 402 to be located at an azimuthal angle of 0°, the remaining cables may be located at 45°, 60°, 90°, 120°, 135°, 180°, and 270°. Of course a greater or lesser number of cables can be provided, but this arrangement is expected to provide a fairly complete picture of the strain distribution within the cement slurry as it hardens.

Figure 5C:
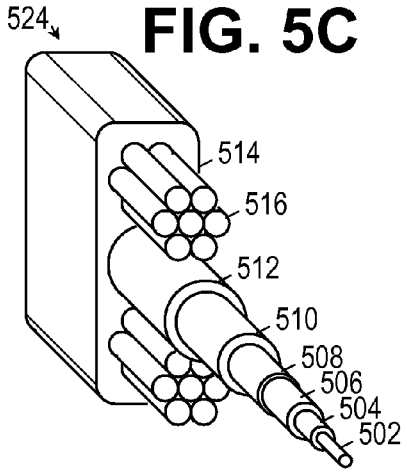
Figure 5D:
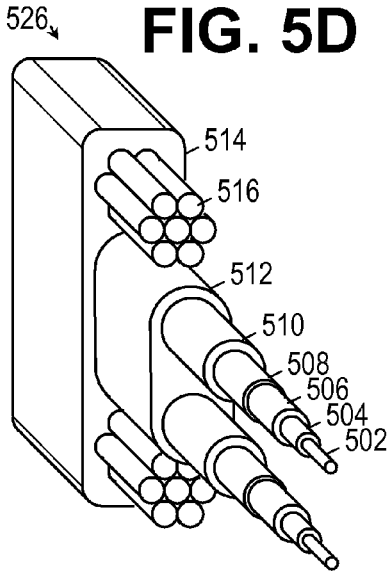

FIG. 5 shows a number of illustrative fiber optic cable constructions suitable for use in the contemplated system. Downhole fiber optic cables are preferably designed to protect small optical fibers from corrosive wellbore fluids and elevated pressures while allowing for direct mechanical coupling (for strain or pressure measurements) or while allowing decoupling of the fibers from strain (for unstressed temperature or vibration/acoustic measurements). These cables may be populated with multimode and singlemode fiber varieties, although alternative embodiments can employ more exotic optical fiber waveguides (such as those from the "holey fiber" regime) for more enhanced supercontinuum and/or optically amplified backscatter measurements.

Each of the illustrated cables has one or more optical fiber cores 502 within cladding layers 504 having a higher refraction index to contain light within the core. A buffer layer 506, barrier layer 508, armor layer 510, inner jacket layer 512, and an outer jacket 514 may surround the core and cladding to provide strength and protection against damage from various dangers including moisture, hydrogen (or other chemical) invasion, and the physical abuse that may be expected to occur in a downhole environment. Illustrative cable 520 has a circular profile that provides the smallest cross section of the illustrated examples. Illustrative cable 522 has a square profile that may provide better mechanical contact and coupling with the outer surface of casing 104. Illustrative cables 524 and 526 have stranded steel wires 516 to provide increased tensile strength. Cable 526 carries multiple fibers 502 which can be configured for different measurements, redundant measurements, or cooperative operation. (As an example of cooperative operation, one fiber can be configured as a "optical pump" fiber that optically excites the other fiber in preparation for measurements via that other fiber). Inner jacket 512 can be designed to provide rigid mechanical coupling between the fibers or to be compliant to avoid transmitting any strain from one fiber to the other.

Figure 6:
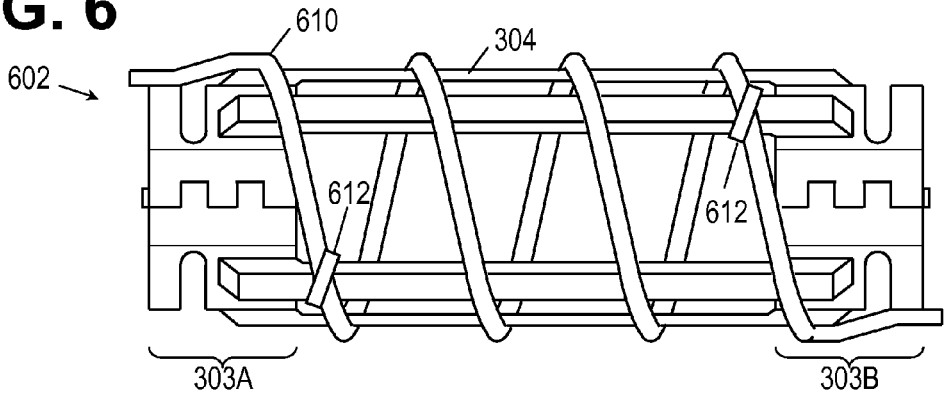
FIG. 6 shows an illustrative helical arrangement for a sensing fiber.
Figure 7:
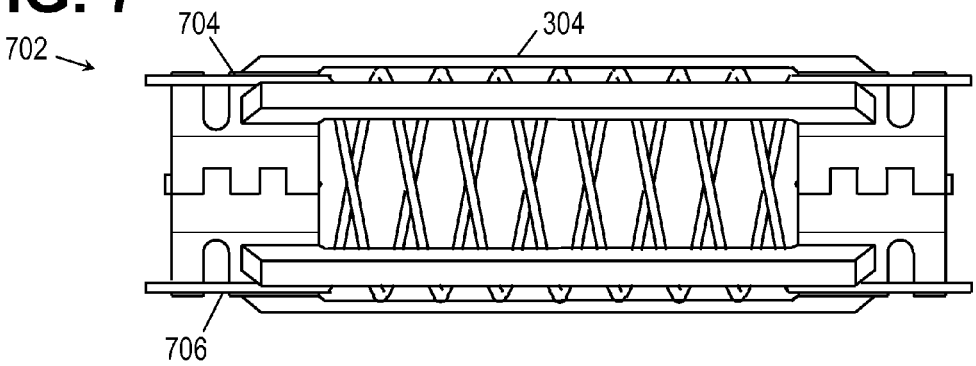
FIG. 7 shows another illustrative helical arrangement with multiple sensing fibers.

To obtain more complete measurements of the cement slurry, the cable can be wound helically on the casing string rather than having it just run axially. FIG. 6 shows an alternative strapping mechanism that might be employed to provide such a helical winding. Strapping mechanism 602 includes two collars 303A, 303B joined by multiple ribs 304 that form a cage once the collars have been closed around the casing string 104. The cable 610 is wound helically around the outside of the cage and secured in place by screw clamps 612. The cage serves to embed the cable 610 into the cement slurry or other fluid surrounding the casing string.

Where a greater degree of protection is desired, the cable can be wound helically around the casing string 104 and the cage mechanism 702 placed over it as illustrated in FIG. 7. FIG. 7 also shows the use of two fiber optic cables 704, 406 wound 180° out of phase. More cables can be employed if desired for additional parameter measurements and/or a greater degree of redundancy. More complete coverage of the annular region is also provided with the increasing number of cables, though such increased coverage can also be obtained with an increased winding angle.

Other mounting approaches can be employed to attach the cables to the casing string. For example, casing string manufacturers now offer molded centralizers or standoffs on their casing. These take can the form of broad fins of material that are directly (e.g., covalently) bonded to the surface of the casing. Available materials include carbon fiber epoxy resins. Slots can be cut or formed into these standoffs to receive and secure the fiber optic cable(s). In some applications, the casing string may be composed of a continuous composite tubing string with optical fibers embedded in the casing wall.

Figure 8:
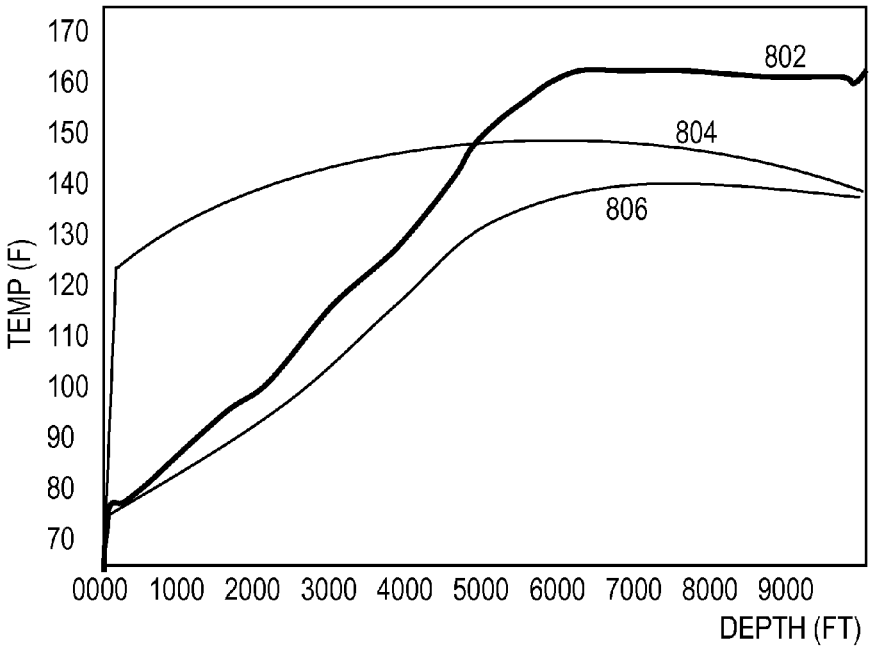
FIGS. 8-9 show an illustrative evolution of a temperature vs. depth profile.

Once the casing string has been lowered into the borehole with the suitably mounted fiber optic cables, the drilling crew can let the apparatus rest, without fluid circulation, to determine a baseline parameter profile. FIG. 8 shows an illustrative baseline parameter profile 802 that is temperature as a function of measured depth in the borehole. The baseline profile reveals a generally increasing temperature with depth from zero to about 6000 feet after which it levels off (as a consequence of the borehole turning from substantially vertical to substantially horizontal). As the crew starts circulating fluid down through the casing and up through the annular space around the casing, the temperature profile changes. Curve 804 represents the temperature profile after about four hours of fluid circulation. Curve 804 shows that the fluid entering the annular space at the bottom of the borehole causes a cooling effect. As the fluid passes along the annular space it collects heat from the formation and transports that heat to the cooler regions of the borehole near the surface.

Once the drilling crew is satisfied that the annular space has been adequately flushed and prepared for cementing, a cement slurry is pumped through the casing into the annular space. Because the cement has a high heat capacity it exhibits a strong cooling effect resulting in a temperature profile similar to curve 806. The contrast in heat capacity is evident to a viewer as a "fall" or sharp drop in the temperature profile that moves along the borehole in pace with the front between the cement slurry and the displaced fluid. Once the cement slurry is in place, the pumps can be momentarily halted while the crew observes the evolution of the profile.

Figure 9:
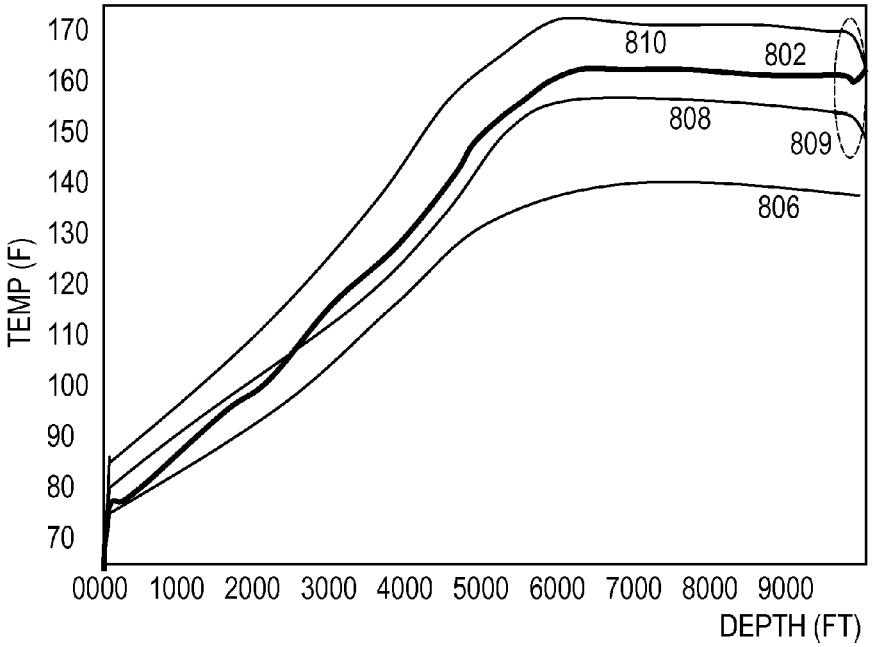

FIG. 9 illustrates the profile evolution after the pumps have been halted. Curve 808 represents the temperature profile about four hours after the cement slurry was injected. The rising temperatures in the annulus are due to at least two factors: the higher formation temperature, and the heat generated by the cement slurry as it cures. This second factor is expected to dominate over the first. Thus portions of the profile that demonstrate slower temperature rises (e.g., the shoe 809 in this example) have no curing, which is most likely attributable to a lack of cement slurry at that point. Curve 810 represents the temperature profile about eight hours after the cement slurry was injected. It can be seen that the heat generated by the curing process has elevated the annular temperature above the baseline profile 802 (except at the shoe 809). This temperature profile may be taken as an indication that a satisfactory cure has been achieved and that further operations will not unintentionally affect the quality of the cement bond.

Note that the curves of FIGS. 8 and 9 are somewhat idealized and the actual curves are expected to demonstrate a much greater degree of variation as a function of depth. Such variation is not due to measurement inaccuracy, but rather it reflects the actual state of the annular space. As cement slurry is injected, in addition to the temperature drop discussed previously, the crew is expected to observe a decrease in this variation attributable to the homogeneity of the cement slurry. The variation may then demonstrate further changes during the curing process and afterwards. Discrepancies in the degree of variation at different positions may also be taken as indicators of the span and gaps in the cement.

Figure 10:
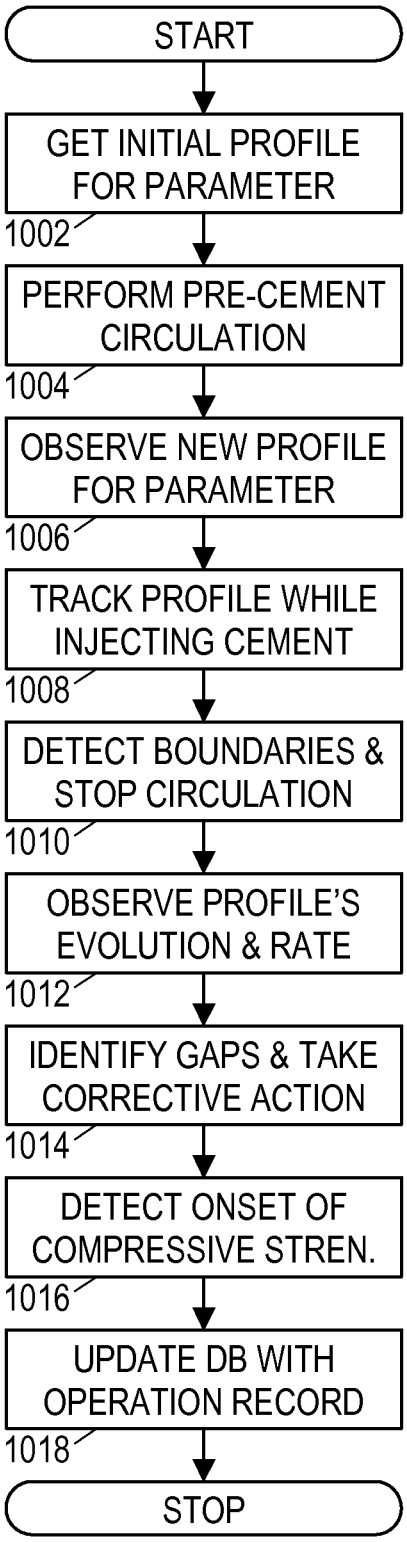
FIG. 10 is a flow diagram of an illustrative cement slurry monitoring method.

FIG. 10 is a flow diagram of an illustrative method for determining the span and gaps in the cement slurry. Beginning in block 1002, the crew uses the cable or distributed sensor array to determine an initial profile for the selected parameter(s) without circulation in the borehole. Contemplated parameters include temperature, pressure, strain, acoustic spectrum, acoustic coupling, and chemical concentration. In block 1004, the crew initiates circulation to flush the borehole and prepare it for cementing.

In block 1006, the parameter profile is measured again. Changes to the profile are tracked as cement slurry is injected in block 1008. These changes are used to determine the boundaries of the cement slurry in block 1010. If temperature is being monitored, the difference between heat capacities of the cement slurry and displaced fluid cause a sudden drop in the temperature profile at the boundaries of the cement slurry. If pressure is being monitored, the difference in densities between the cement slurry and displaced fluid demonstrate a cause a change in pressure gradient which indicates the boundary of the cement slurry. If strain is being monitored, the cement slurry will induce strains as it cures, distinguishing it from the fluid-filled regions of the borehole. If the acoustic spectrum is being monitored, the cement slurry is expected to provide a different flow noise than the displaced fluid, so characterizations of the spectrum will reveal where the boundaries exist. Similarly, the acoustic noise produced by the curing process is expected to be absent where the cement slurry is absent. Active sound sources (e.g., piezoelectric transducers, thumpers, vibrators, air-guns, chemical impulse charges, fizzing or other internal gas evolution) in the casing can transmit broad spectrum noise or frequency sweeps that, when measured by the annular sensors, will indicate acoustic coupling strength and/or resonance of loosely coupled (uncemented) cable sections. If chemical concentrations are being monitored, the curing process is expected to release hydroxl (OH) ions that will serve as indicators of the presence of the cement slurry.

When the crew is satisfied with the location of the cement slurry, they can stop pumping and observe the evolution of the parameter profile in block 1012. Discrepancies in the profiles evolution can be used in block 1014 to identify gaps in the cement slurry sheath. Such gaps can be the result of fluid influx during curing, which can be indicated by the anomalous change in temperature and hydrostatic pressure. If needed, the crew can take corrective actions, such as increasing annular pressure to prevent fluid influx and maintaining it until the temperature profile indicates the required degree of cement slurry hydration. Shakers attached to the casing can be activated to break up gel states and enable the cement slurry to flow better and transfer pressure better.

In block 1016, the profile evolution indicates that the cement slurry has set, i.e., has reached the onset of compressive strength. This indication can come from a predetermined temperature threshold (or a predetermined temperature rate of change), a stabilization of the pressure, a predetermined strain threshold, an acoustic coupling threshold, a predetermined chemical concentration, etc. This time point can then be used to start the clock for further well operations. In block 1018, the recorded parameter profiles and evolution is added to a database to improve modeling for subsequent jobs.

Although the foregoing disclosure describes the sensor cable or sensor array as being mounted on the casing string, alternative system embodiments may employ "pumpable" sensors that are carried into place by the cement slurry itself. Such sensors can be battery powered and communicate wirelessly with each other to establish a peer-to-peer network and thereby communicate with the surface. (The RuBee wireless standard is contemplated for this purpose). Alternatively, or in addition, a wireline tool can be lowered into the casing to interrogate the wireless sensors, whether pumped or mounted to the casing.

The foregoing description has focused on determining the extent of the cement slurry and the presence of any gaps. A more general measure of the cement slurry's health during curing may include components indicative of water influx, gas influx, hydrocarbon influx, stress change, shrinkage or expansion, pressure change, temperature change. Taken individually or in combination, these components indicate potential problems with the integrity of the cement sheath.

Numerous other variations and modifications will become apparent to those skilled in the art once the above disclosure is fully appreciated. It is intended that the following claims be interpreted to embrace all such variations and modifications.

What is claimed is:

1. A cementing method that comprises:

monitoring one or more parameters of a cement slurry at various positions along a borehole during at least some portion of a curing process;

determining from said one or more parameters a span over which the cement slurry extends and whether said span includes any gaps; and adjusting the cement slurry in response to said determining, wherein adjusting the cement slurry comprises employing one or more vibrators or sound sources to maintain non-gel flow properties as the cement slurry is pumped.

2. The method of claim 1, further comprising deriving at least a qualitative measure of integrity for the cement slurry as it cures into a cement sheath.

3. The method of claim 2, wherein said one or more parameters includes a measure of stress or strain.

4. The method of claim 1, wherein said one or more parameters includes a measure of cement-mediated coupling to the one or more vibrators or sound sources.

5. The method of claim 1, wherein said one or more parameters includes temperature.

6. The method of claim 1, wherein said one or more parameters includes temperature, and wherein said determining includes identifying different materials based on different temperature versus time profiles.

7. The method of claim 1, wherein said monitoring includes using a distributed sensing system that includes at least one optical fiber extending along the borehole.

8. The method of claim 7, wherein the at least one optical fiber is mounted to an outer surface of a casing string in the borehole.

9. The method of claim 8, wherein the at least one optical fiber extends in a helix around the casing between casing joints.

10. A cementing method that comprises:

monitoring one or more parameters of cement slurry at various positions along a borehole during at least some portion of a curing process;

determining from said one or more parameters a span over which the cement slurry extends and whether said span includes any gaps; and adjusting the cement slurry in response to said determining, wherein adjusting the cement slurry comprises supplying agitation energy to the cement slurry if gaps are detected.

11. A cementing method that comprises:

monitoring one or more parameters of cement slurry at various positions along a borehole during at least some portion of a curing process;

determining from said one or more parameters a span over which the cement slurry extends and whether said span includes any gaps; and adjusting the cement slurry in response to said determining, wherein adjusting the cement slurry comprises increasing pressure on the cement slurry if detected gaps are attributable to formation fluid influx.

12. The method of claim 11, further comprising determining from said one or more parameters whether the cement slurry is in a gel state and, if so, adjusting the cement slurry by supplying agitation energy to communicate increased pressure throughout the cement slurry.

13. A cementing system that comprises:

a measurement unit that couples to at least one optical fiber positioned in a borehole, wherein the measurement unit collects distributed measurements of at least one parameter of a cement slurry during at least one portion of a curing process;

at least one processor that operates on said at least one parameter to determine a span over which the cement slurry extends and any gaps in said span;

a display that provides a user with an indication of said span and said gaps, if any; and at least one tool to adjust the cement slurry in response to said determining a span and any gaps in said span, wherein the at least one tool comprises one or more agitators coupled to said casing string, wherein said one or more agitators operate to supply agitation energy to the cement slurry.

14. The system of claim 13, wherein said optical fiber is mounted on an outer surface of a casing string in the borehole to contact said cement slurry.

15. The system of claim 14, wherein the at least one optical fiber extends in a helix around the casing between casing joints.

16. The system of claim 13, wherein the processor derives a phase state of the cement slurry from the at least one parameter.

17. The system of claim 13, wherein the at least one parameter includes temperature.

18. The system of claim 13, wherein said at least one parameter includes temperature, and wherein said processor identifies said span and said gap by classifying temperature versus time profiles at different positions in the borehole.

19. A cementing system that comprises:

a measurement unit that couples to at least one optical fiber positioned in a borehole, wherein the measurement unit collects distributed measurements of at least one parameter of a cement slurry during at least one portion of a curing process;

at least one processor that operates on said at least one parameter to determine a span over which the cement slurry extends and any gaps in said span;

a display that provides a user with an indication of said span and said gaps, if any; and at least one tool to adjust the cement slurry in response to said determining a span and any gaps in said span, wherein the at least one tool comprises a pump that applies additional pressure to the cement slurry in response to detection of gaps in said span.

20. A cementing system that comprises:

a measurement unit that couples to at least one optical fiber positioned in a borehole, wherein the measurement unit collects distributed measurements of at least one parameter of a cement slurry during at least one portion of a curing process;

at least one processor that operates on said at least one parameter to determine a span over which the cement slurry extends and any gaps in said span;

a display that provides a user with an indication of said span and said gaps, if any; and at least one tool to adjust the cement slurry in response to said determining a span and any gaps in said span, wherein the at least one parameter includes acoustic activity produced by curing of the cement slurry.

21. A cementing system that comprises:

a measurement unit that couples to at least one optical fiber positioned in a borehole, wherein the measurement unit collects distributed measurements of at least one parameter of a cement slurry during at least one portion of a curing process;

at least one processor that operates on said at least one parameter to determine a span over which the cement slurry extends and any gaps in said span;

a display that provides a user with an indication of said span and said gaps, if any; and at least one tool to adjust the cement slurry in response to said determining a span and any gaps in said span, wherein the at least one tool comprises a source of acoustic energy in the borehole, and wherein the at least one parameter includes coupling of the acoustic energy to the fiber.

* * * * *